US009168986B1

(12) United States Patent
Wachter

(10) Patent No.: US 9,168,986 B1
(45) Date of Patent: Oct. 27, 2015

(54) ELONGATED RECREATIONAL FLOTATION DEVICE

(71) Applicant: Jaclyn Wachter, Old Westbury, NY (US)

(72) Inventor: Jaclyn Wachter, Old Westbury, NY (US)

( * ) Notice: Subject to any disclaimer, the term of this patent is extended or adjusted under 35 U.S.C. 154(b) by 0 days.

(21) Appl. No.: 14/444,570

(22) Filed: Jul. 28, 2014

(51) Int. Cl.
*B63B 35/74* (2006.01)

(52) U.S. Cl.
CPC ..... *B63B 35/74* (2013.01)

(58) Field of Classification Search
CPC ..... B63B 35/73
USPC ..... 441/129–132
See application file for complete search history.

(56) References Cited

U.S. PATENT DOCUMENTS

| | | | | | |
|---|---|---|---|---|---|
| RE27,666 | E | * | 6/1973 | Dean | 114/219 |
| 5,520,561 | A | * | 5/1996 | Langenohl | 441/129 |
| 5,628,658 | A | * | 5/1997 | Clifford | 441/130 |
| 5,885,123 | A | | 3/1999 | Clifford | |
| 5,971,823 | A | | 10/1999 | Sanso | |
| 6,106,349 | A | | 8/2000 | Motosko | |
| 6,276,979 | B1 | * | 8/2001 | Saltel et al. | 441/132 |
| 6,790,112 | B2 | * | 9/2004 | Kirk | 441/129 |
| 7,008,281 | B2 | * | 3/2006 | Ketko | 441/130 |
| 7,318,762 | B2 | * | 1/2008 | Goldmeier | 441/129 |
| 7,914,352 | B2 | * | 3/2011 | Williams | 441/129 |
| 8,651,909 | B2 | * | 2/2014 | Romzek | 441/129 |
| 9,039,473 | B1 | * | 5/2015 | Wachter | 441/129 |
| 2005/0106963 | A1 | * | 5/2005 | Ross | 441/129 |
| 2008/0124991 | A1 | | 5/2008 | Kolarick et al. | |
| 2008/0176467 | A1 | * | 7/2008 | Williams | 441/129 |
| 2012/0269570 | A1 | | 10/2012 | Felber | |
| 2013/0052896 | A1 | * | 2/2013 | Abraham | 441/129 |
| 2013/0280972 | A1 | | 10/2013 | Cheung | |

* cited by examiner

*Primary Examiner* — Lars A Olson
*Assistant Examiner* — Jovon Hayes
(74) *Attorney, Agent, or Firm* — Carter, DeLuca, Farrell & Schmidt, LLP

(57) ABSTRACT

A flotation device includes an elongated and flexible member with a channel extending between longitudinal ends of the flexible member. The flexible member is configured to support an individual within water during a recreational activity. A cap is secured to the flexible member having a shaft suitably dimensioned to fit within the channel of the flexible member to secure the cap to the flexible member. A sleeve having a body member is dimensioned to fit over the flexible member and act as the flexible member's skin. The sleeve can also be dimensioned to fit over the flexible member and the cap for acting as the flexible member's and the cap's skin. The flexible member has at least one cut-out which corresponds to or is aligned with at least one cut-out of the sleeve.

7 Claims, 6 Drawing Sheets

ELONGATED RECREATIONAL FLOTATION DEVICE

BACKGROUND

1. Technical Field

The present disclosure relates to an elongated, recreational flotation device for use in pools and other bodies of water.

2. Description of the Related Art

Flotation devices, such as inflatable or floating rafts, are well known for use in recreational water activities. One particular device that has recently become popular for use in pools and at beaches is an elongated flotation device that is shaped in the form of a noodle and is made of a flexible material (e.g., foam) that has a sufficient buoyancy to support a user at the water surface during use.

It is desirable to provide floatation devices that have simple designs and provide additional recreational and aesthetic features.

SUMMARY

In accordance with an embodiment of the present disclosure, there is provided a flotation device having an elongated and flexible member including a channel extending between longitudinal ends of the flexible member. The flexible member is configured to support an individual in a body of water at the water surface. The flotation device further includes a sleeve having a body member dimensioned to be fit over the flexible member.

In embodiments, the body member is an elongated cylindrical body member made from material which is stretchable, such as fabric. The body member is dimensioned to be fit over the flexible member and act as the flexible member's skin.

In embodiments, the body member does not overlay the openings of the channel when fit on the flexible member. In other embodiments, the body member overlays or covers the entire flotation device.

In embodiments, the body member can be made from various materials, such as fabric, polymeric material, elastic material, etc. In embodiments, the body member can have one color, multiple colors, graphics, lettering, and/or indicia thereon.

In embodiments, a ring can be provided at each end of the body member for tightening the body member around the ends of the flexible member to provide a tight fit of the body member on the flexible member. The ring can be made from the same material as the body member and be unitary with the body member, such as, for example, a fabric ring, or from a different material, such as an elastic band secured to the ends of the body member. Alternatively, the ring can be embedded within a pocket formed at each end of the body member.

In accordance another embodiment of the present disclosure, there is provided a flotation device which includes an elongated and flexible member with a channel extending between longitudinal ends of the flexible member. The flexible member is configured to support an individual within water during a recreational activity. The flotation device includes a cap having a rounded (or other geometric configuration) ball or portion. The shaft is suitably dimensioned to fit within the channel of the flexible member to secure the cap to the flexible member.

In accordance with another embodiment of the present disclosure, there is provided a flotation device which includes an elongated and flexible member with a channel extending between longitudinal ends of the flexible member. The flexible member is configured to support an individual within water during a recreational activity. The flotation device includes a pair of cut-outs near each longitudinal end of the flexible member, where each cut-out of the pair of cut-outs defines a handle for placement of one's hand therein to grasp and hold the flotation device or to pull the flotation device, such as when another person is holding the flotation device using the other cut-out and pulling away as in a tug-of-war game.

The above-mentioned embodiments and other embodiments described herein can be combined in one embodiment, such as, for example, an embodiment of a flotation device with a flexible member having at least one cut-out and a cap, such as the ball cap, inserted at at least one end of the flexible member. This embodiment can also be fitted with a sleeve which is dimensioned to cover the flexible member. The sleeve can have at least one cut-out for corresponding to or aligning with the at least one cut-out of the flexible member when fitted over the flexible member, such that the sleeve does not cover the at least one cut-out of the flexible member. The sleeve, however, can be dimensioned to cover the entire flotation device, including the openings of the channel.

The above and still further objects, features and advantages of the present disclosure will become apparent upon consideration of the following descriptions and descriptive figures of specific embodiments thereof, wherein like reference numerals in the various figures are utilized to designate like components. While these descriptions go into specific details of the present disclosure, it should be understood that variations may and do exist and would be apparent to those skilled in the art based on the descriptions herein.

DESCRIPTION OF THE PREFERRED EMBODIMENTS

Figure 1:
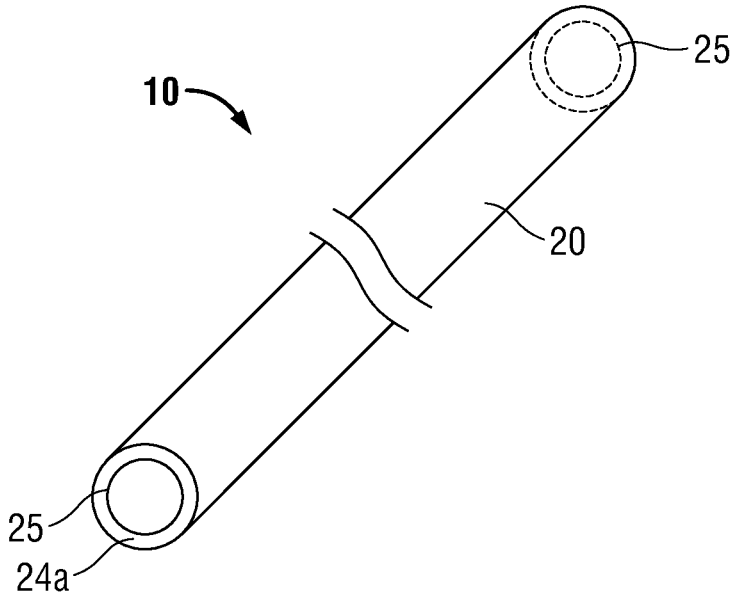
FIG. 1 depicts a perspective view of a sleeve or covering for a flotation device of the type having an elongated and flexible member with a channel extending between longitudinal ends of the flexible member in accordance with the present disclosure.
Figure 2:
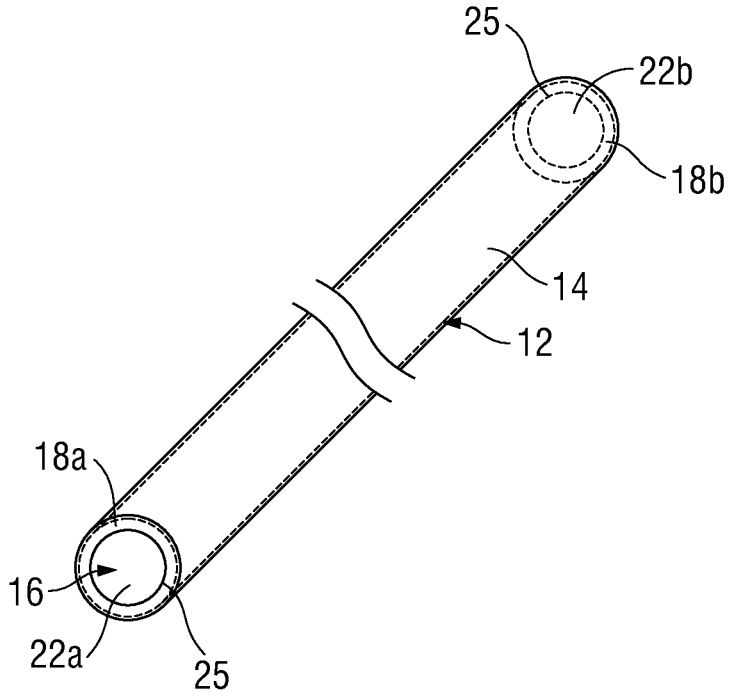
FIG. 2 depicts a perspective view of the sleeve shown by FIG. 1 overlaying or covering a flotation device shown in phantom in accordance with the present disclosure.

Exemplary embodiments of the present disclosure will now be described with reference to FIGS. 1-14. In particular, FIG. 1 depicts a perspective view of a sleeve or covering designated generally by reference numeral 10. The sleeve 10 is configured and dimensioned for covering an elongated flotation device 12 shown in phantom by FIG. 2. The flotation device 12 includes an elongated, generally cylindrical section or flexible member 14 that is constructed of a soft foam material that has a sufficient buoyancy to serve as a general flotation device by a user during recreational activity.

Alternatively, the flexible member 14 may be constructed of any other suitable flexible material that has suitable buoyancy and may also have any other selected cross-sectional geometric configuration (e.g., square, multifaceted, etc.). The flexible member 14 is hollow and includes a narrow channel 16 that extends between the ends 18*a*, 18*b* of the flexible member 14.

The sleeve 10 has an elongated, generally cylindrical body member 20 made from material which is stretchable, such as fabric. Other types of materials, such as polymeric materials, elastic materials, and non-stretchable materials, can be used for manufacturing the sleeve 10. The body member 20 is dimensioned to be fit over the flexible member 14 and act as the flexible member's skin. The body member 20, in the embodiment shown by FIG. 1, does not overlay the openings 22*a*, 22*b* of the channel 16 when fit on the flexible member 14. However, in other embodiments, the body member 20 can be dimensioned to overlay the openings 22*a*, 22*b*, such as the embodiment shown by FIG. 11A.

Each end 24*a*, 24*b* of the sleeve 10 includes a ring 25 to make the ends 24*a*, 24*b* rigid and tight against the ends 18*a*, 18*b* of the flexible member 14. The ring 25 can made from the same material as the body member 20 and be unitary with the body member 20, such as, for example, a fabric ring (i.e., the fabric of the body member 20 is tightly woven at the ends 24*a*, 24*b*), or be made from a separate material, such as an elastic band woven or secured to the ends 24*a*, 24*b*.

Figure 3:
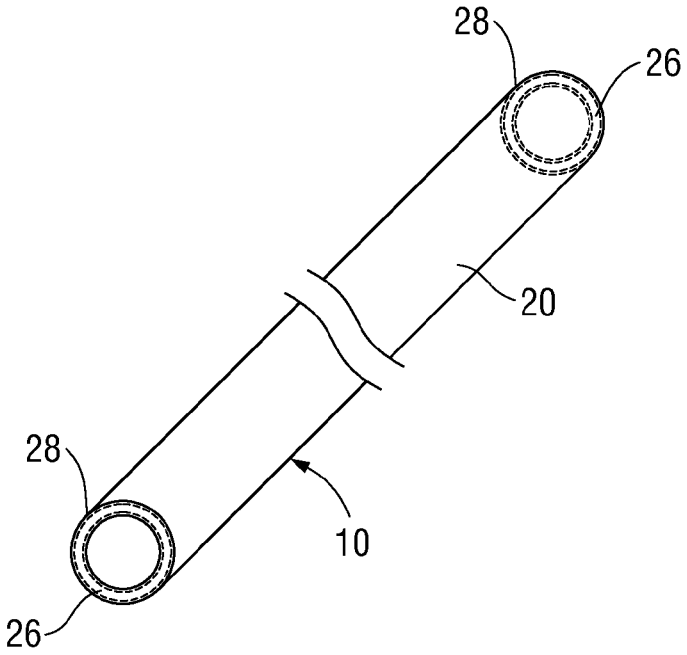
FIG. 3 depicts a perspective view of an alternative embodiment for the sleeve shown by FIG. 1 where each end of the sleeve includes a ring shown in phantom in accordance with the present disclosure.

With reference to FIG. 3, there is shown an alternative embodiment of the sleeve shown in FIG. 1. In this embodiment, in order to make each end 24*a*, 24*b* of the sleeve 10 rigid, instead of a fabric ring or elastic band, a ring 26 or circular disc is provided at each end of the body member 20 for tightening the body member 20 around each end 18*a*, 18*b* of the flexible member 14 to provide a tight fit of the body member 20 on the flexible member 14. The ring 26 is embedded within a pocket 28 formed at each end of the body member 20. The body member 20 can have one color, multiple colors, graphics, lettering, and/or indicia thereon.

Figure 5:
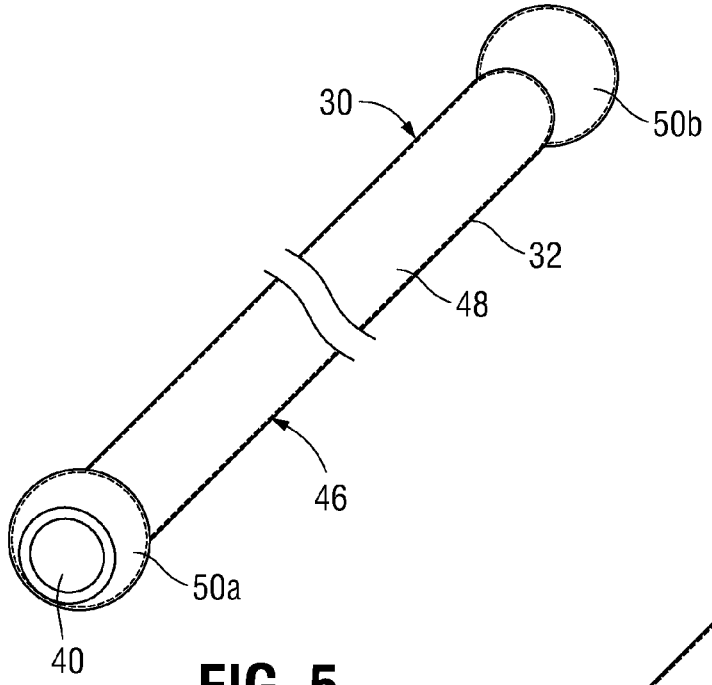
FIG. 5 depicts a perspective view of the sleeve shown by FIG. 4 overlaying or covering a flotation device and two ball caps shown in phantom in accordance with the present disclosure.

With reference to FIGS. 5, and 7-9, in accordance other embodiments of the present disclosure, there is shown a flotation device 30 (see FIGS. 5 (device 30 shown in phantom), 8, and 9) which includes an elongated and flexible member 32 with a channel 34 extending between longitudinal ends 36*a*, 36*b* of the flexible member 32. The flexible member 32 is configured to support an individual within water during a recreational activity. In order to do this, the elongated, flexible member 32 is constructed of a soft foam material that has a sufficient buoyancy to serve as a general flotation device by a user during recreational activity.

Alternatively, the flexible members described herein, such as flexible member 32, may be constructed of any other suitable flexible material that has suitable buoyancy and may also have any other selected cross-sectional geometric configuration (e.g., square, multifaceted, etc.).

The flotation device 30 includes a cap 38 (see FIG. 7) having a substantially rounded (or other geometrical configuration) ball or portion 40 and a shaft 42 protruding from a flat surface 44 of the substantially rounded portion 40. The shaft 42 is suitably dimensioned to fit within the channel 30 of the flexible member 32 to secure the cap 38 to the flexible member 32 as shown by FIGS. 5, 6, 8, and 9.

Figure 4:
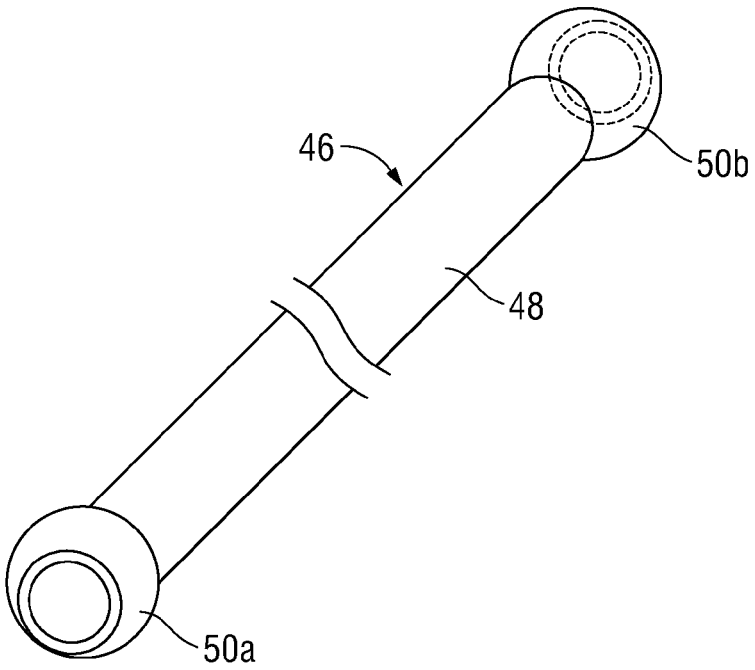
FIG. 4 depicts a perspective view of an alternate embodiment for the sleeve or covering according to the present disclosure.
Figure 6:
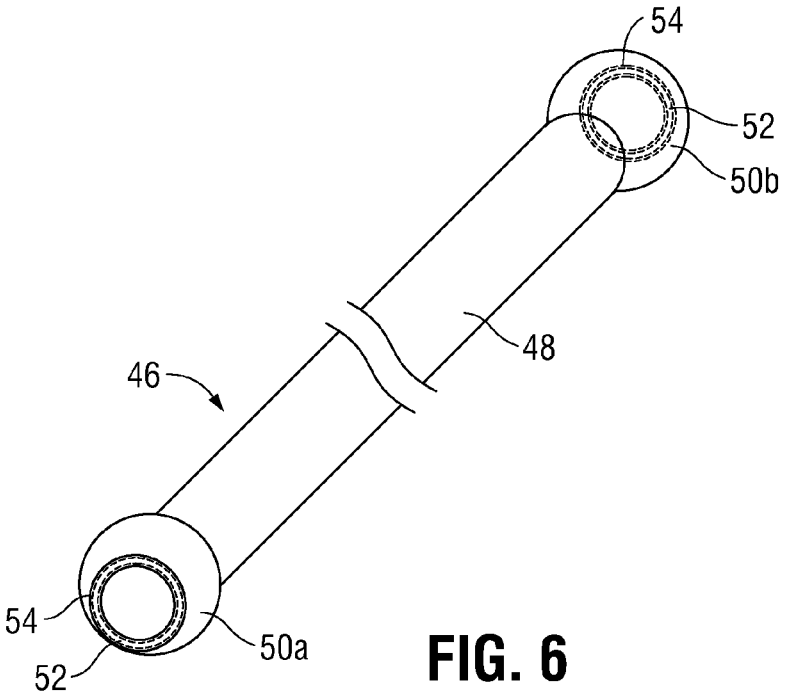
FIG. 6 depicts a perspective view of the sleeve embodiment shown by FIG. 4 and a ring at each end of the sleeve shown in phantom in accordance with the present disclosure.
Figure 7:
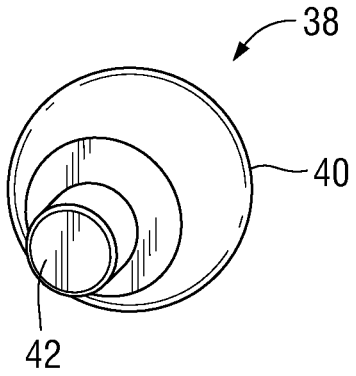
FIG. 7 is a perspective view of a ball cap configured for fitting at an end of the flotation device in accordance with the present disclosure.
Figure 8:
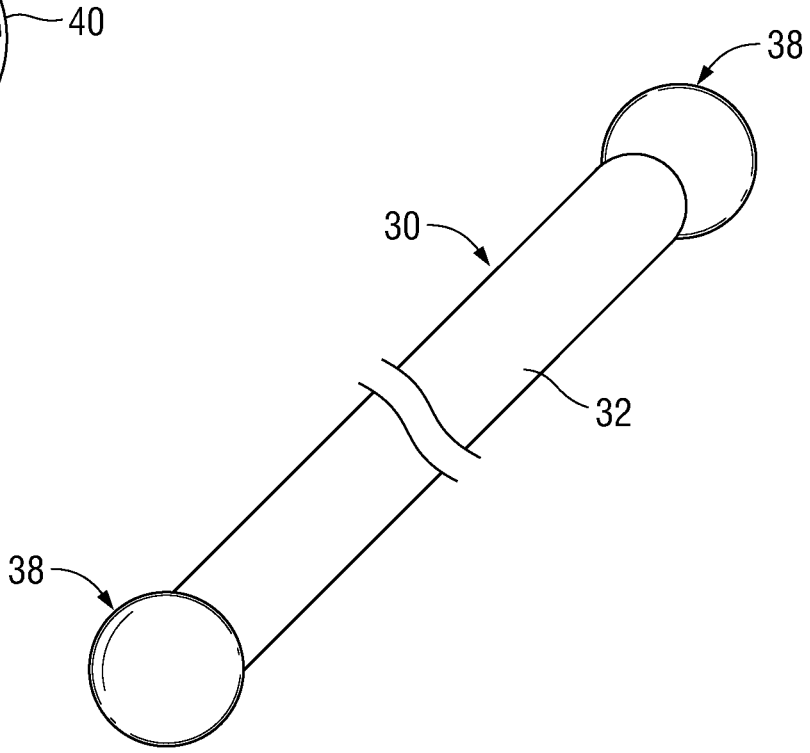
FIG. 8 is a perspective view of a flotation device having two ball caps at the ends in accordance with the present disclosure.
Figure 9:
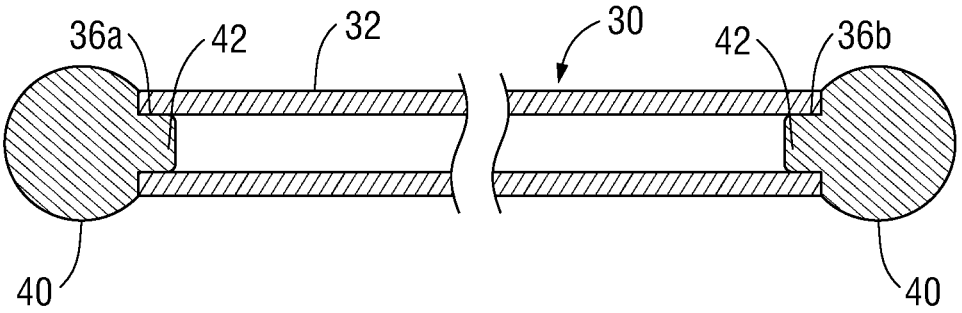
FIG. 9 is a cross-sectional view of FIG. 8.

A sleeve or covering 46 is shown by FIGS. 4-6 dimensioned to be fit over the flotation device 30 and caps 38. The sleeve 46 has an elongated, generally cylindrical body member 48 with rounded ends 50*a*, 50*b*. The body member 48 and rounded ends 50*a*, 50*b* are made from material which is stretchable, such as fabric. Other types of materials, such as polymeric materials, elastic materials, and non-stretchable materials, can be used for manufacturing the sleeve 46. The body member 48 is dimensioned to be fit over the flexible member 32 and act as the skin of the flexible member 32. The rounded ends 50*a*, 50*b* are also dimensioned to be fit over the caps 38 attached to the flexible member 32 and act as the skin of the two caps 38.

Figure 5A:
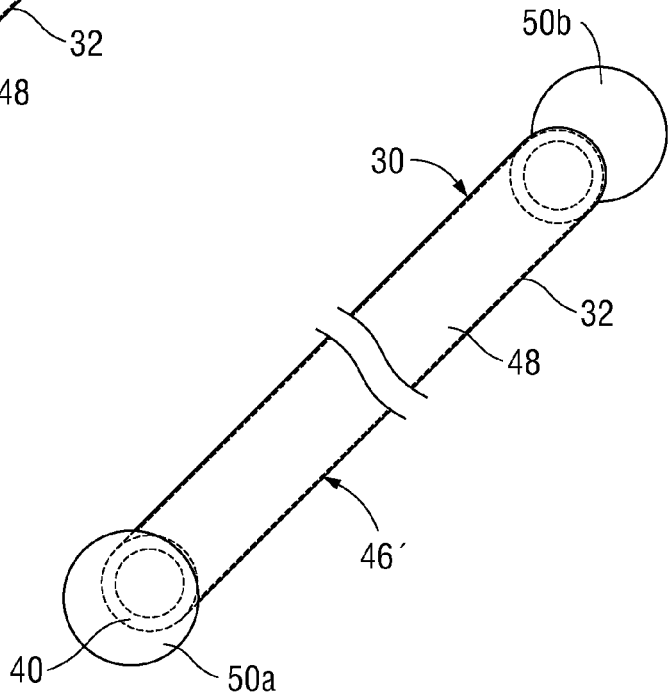
FIG. 5A depicts a perspective view of an alternative embodiment of the sleeve similar or identical to the embodiment shown by FIG. 1 in accordance with the present disclosure.

In an alternate embodiment, as shown by FIG. 5A, the sleeve 46 does not have the rounded ends 50*a*, 50*b*. In this embodiment, sleeve 46' is identical or similar to sleeve 10 shown by FIG. 1. The sleeve 46' is fitted over the flexible member 32 and acts as the flexible member's skin. That is, the sleeve 46' does not overlay the caps 38.

As with the embodiment described above with reference to FIGS. 1-3, in order to make the ends 50*a*, 50*b* of the sleeve 46 rigid, a ring 52 is provided at each end of the body member 48 for tightening the body member 48 around each end 50*a*, 50*b* of the flexible member 32 to provide a tight fit of the body member 48 on the flexible member 32. The ring 52 can be made from the same material as the body member 48 and be unitary with the body member 48, such as, for example, a fabric ring, or from a different material, such as an elastic band secured to the ends 50*a*, 50*b*, as described above with reference to FIG. 3. Alternatively, as shown by FIG. 6, the ring 52 can be a circular disc embedded within a pocket 54 formed at each end 50*a*, 50*b*. The body member 48 can have one color, multiple colors, graphics, lettering, and/or indicia thereon.

Figure 11:
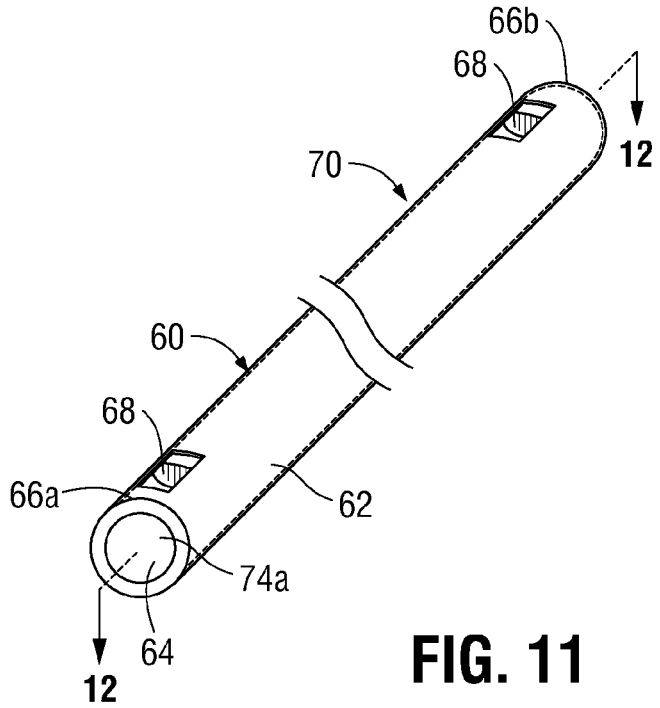
FIG. 11 is a perspective view of the sleeve embodiment shown in FIG. 10 overlaying or covering a flotation device shown in phantom in accordance with the present disclosure.
Figure 12:
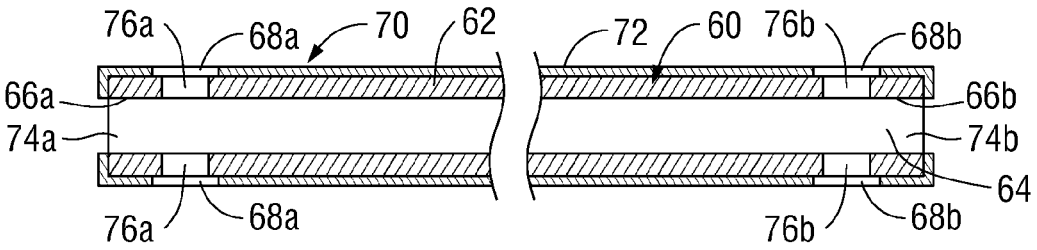
FIG. 12 is a cross-sectional view of FIG. 11.

In accordance with another embodiment of the present disclosure, and with reference to FIGS. 11 and 12, there is provided a flotation device designated by reference numeral 60. Flotation device 60 includes an elongated and flexible member 62 with a channel 64 extending between longitudinal ends 66*a*, 66*b* of the flexible member 62. The flexible member

62 is configured to support an individual within water during a recreational activity. In order to do this, the elongated, flexible member 62 is constructed of a soft foam material that has a sufficient buoyancy to serve as a general flotation device by a user during recreational activity.

The flotation device 60 includes two pairs of cut-outs 68*a*, 68*b* near each longitudinal end 66*a*, 66*b* of the flexible member 62. Each cut-out 68 of the two pairs of cut-outs 68*a*, 68*b* defines a handle for placement of one's hand therein to grasp and hold the flotation device 60 or to pull the flotation device 60, such as when another person is holding the flotation device 60 using the other cut-out and pulling away as in a tug-of-war game.

Figure 10:
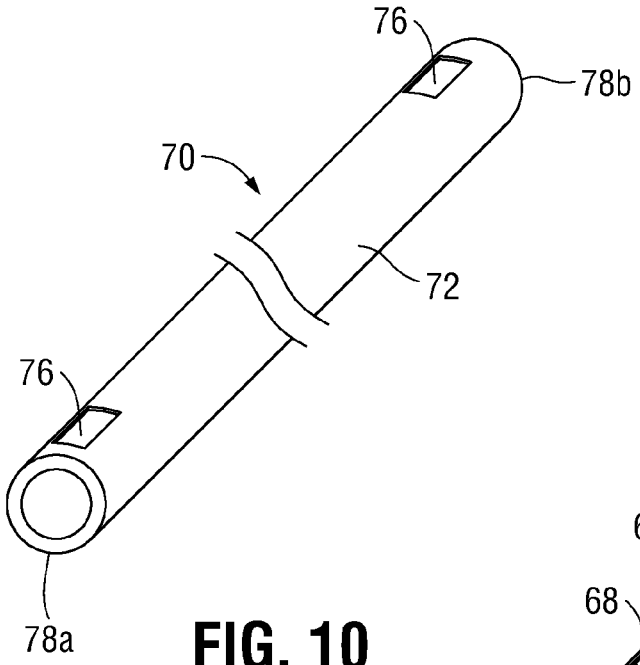
FIG. 10 is a perspective view of an alternate embodiment for the sleeve or covering having two pairs of cut-outs according to the present disclosure.

FIG. 10 depicts a perspective view of a sleeve or covering designated generally by reference numeral 70. The sleeve 70 is configured and dimensioned for covering the elongated flotation device 60 shown in phantom by FIG. 11 and by the cross-sectional view of FIG. 12. The sleeve 70 has an elongated, generally cylindrical body member 72 made from material which is stretchable, such as fabric. Other types of materials, such as polymeric materials, elastic materials, and non-stretchable materials, can be used for manufacturing the sleeve 70. The body member 72 is dimensioned to be fit over the flexible member 62 and act as the flexible member's skin. Preferably, the body member 72 does not overlay openings 74*a*, 74*b* of the channel 64 when fit on the flexible member 62.

The body member 72 includes two pairs of cut-outs 76*a*, 76*b*. Each cut-out 76 of the two pairs of cut-outs 76*a*, 76*b* substantially aligns with a respective cut-out 68 of the flexible member 62 a shown by the cross-sectional view of FIG. 12.

As with the embodiments described above with reference to FIGS. 1-6, in order to make the ends 78*a*, 78*b* of the sleeve 70 rigid, a ring (not shown) is provided at each end of the body member 72 for tightening the body member 72 around each end 66*a*, 66*b* of the flexible member 62 to provide a tight fit of the body member 72 on the flexible member 62. The ring can be made from the same material as the body member 72 and be unitary with the body member 72, such as, for example, a fabric ring, or from a different material, such as an elastic band secured to the ends 78*a*, 78*b*. Alternatively, similar to FIGS. 3 and 6, the ring can be embedded within a pocket (not shown) formed at each end 78*a*, 78*b*. The body member 72 can have one color, multiple colors, graphics, lettering, and/or indicia thereon.

Figure 11A:
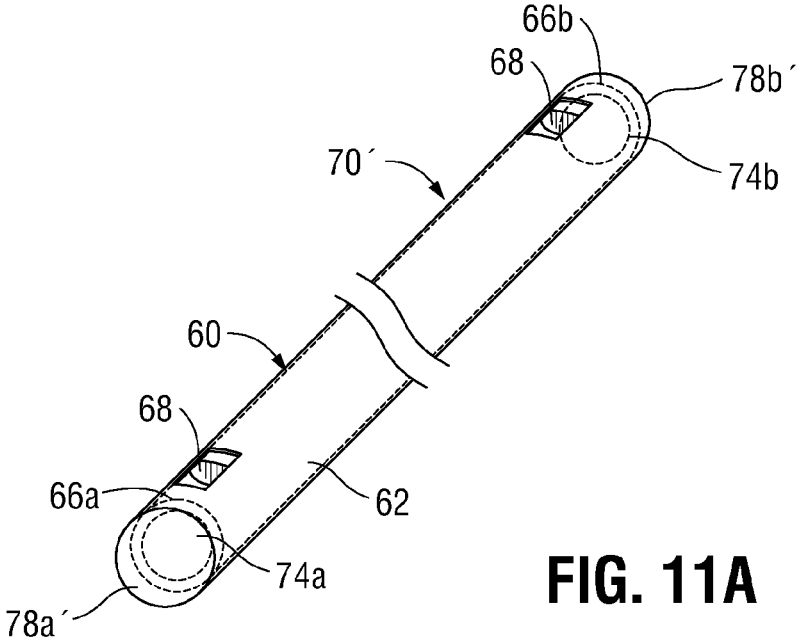
FIG. 11A is perspective view of an alternate sleeve embodiment of the embodiment shown in FIG. 10 where the ends of the sleeve overlay or cover the open ends of the flotation device shown in phantom in accordance with the present disclosure.

FIG. 11A is perspective view of an alternate sleeve embodiment of the embodiment shown in FIG. 10 where the ends 78*a*', 78*b*' of the sleeve 70' overlay or cover the open ends 74*a*, 74*b* of the flotation device 60. In this embodiment, the channel 64 is not visible due to the sleeve 70' covering the entire flotation device 60.

The above-mentioned embodiments can be combined in one embodiment, such as, for example, an embodiment of a flotation device with a flexible member having at least one cut-out and a cap, such as the ball cap, inserted at at least one end of the flexible member. This embodiment can also be fitted with a sleeve which is dimensioned to fit over the flexible member.

Figure 13:
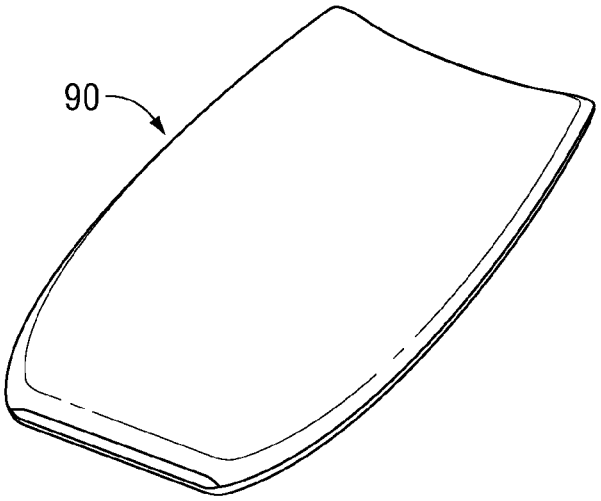
FIG. 13 is a perspective view of an alternate embodiment for the sleeve or covering according to the present disclosure.
Figure 14:
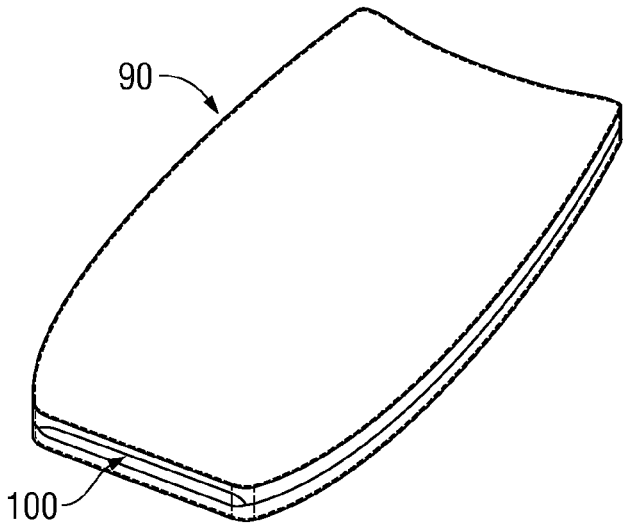
FIG. 14 is a perspective view of the sleeve embodiment shown by FIG. 13 overlaying or covering a flotation device, such as a boogie board, shown in phantom in accordance with the present disclosure.

Other embodiments of a sleeve in combination with a flotation device are envisioned within the scope of the present disclosure, such as a sleeve 90 configured and dimensioned for fitting over a flotation device 100, such as a boogie board, as shown by FIGS. 13 and 14.

Having described preferred embodiments of an elongated flotation device, it is believed that other modifications, variations and changes will be suggested to those skilled in the art in view of the teachings set forth herein. It is therefore to be understood that all such variations, modifications and changes are believed to fall within the scope of the present disclosure as defined by the appended claims. Although specific terms are employed herein, they are used in a generic and descriptive sense only and not for purposes of limitation.

The invention claimed is:

1. A flotation device comprising:

an elongated and flexible member including a channel extending between longitudinal ends of the flexible member, the flexible member being configured to support an individual in a body of water at the water surface;

a cap securable to the flexible member, the cap comprising a shaft suitably dimensioned to fit within the channel of the flexible member to secure the cap to the flexible member; and a sleeve having a body member dimensioned to be fit over the flexible member and cap and act as the flexible member's and cap's skin.

2. The flotation device according to claim 1, wherein the flexible member has at least one cut-out defining a handle.

3. The flotation device according to claim 1, wherein the flexible member has two cut-outs, one cut-out near one longitudinal end of the flexible member and another cut-out near the other longitudinal end of the flexible member, and wherein each cut-out defines a handle.

4. The flotation device according to claim 1, wherein the cap is a ball cap comprising a substantially rounded ball adjacent to the shaft.

5. The flotation device according to claim 1, wherein the sleeve includes a pocket on at least one end of the body member; and further comprising a circular disc at least partially embedded within the pocket.

6. The flotation device according to claim 5, wherein the circular disc is configured for making at least one end of the sleeve rigid.

7. The flotation device according to claim 5, wherein the circular disc is separate and apart from the sleeve and the elongated body member.

* * * * *